US005318109A

United States Patent [19]

Yamada et al.

[11] Patent Number: 5,318,109

[45] Date of Patent: Jun. 7, 1994

[54] HEAT EXCHANGE APPARATUS

[75] Inventors: Minoru Yamada, Yokohama; Akira Nemoto, Tokyo, both of Japan

[73] Assignee: Kabushiki Kaisha Toshiba, Kawasaki, Japan

[21] Appl. No.: 978,776

[22] Filed: Nov. 19, 1992

[30] Foreign Application Priority Data

Nov. 20, 1991 [JP] Japan ..... 305084

[51] Int. Cl.[5] ..... F28F 7/00

[52] U.S. Cl. ..... 165/135; 165/172; 122/4 R

[58] Field of Search ..... 165/134.1, 135, 172; 122/4 R

[56] References Cited

U.S. PATENT DOCUMENTS

| | | | |
|---|---|---|---|
| 2,893,509 | 7/1959 | Baird | 181/46 |
| 3,263,654 | 8/1966 | Cohan et al. | 122/4 R |
| 3,265,040 | 8/1966 | Chen | 122/4 R |
| 3,651,788 | 3/1972 | Chayes | 122/4 R |
| 4,226,279 | 10/1980 | Eisinger et al. | 165/1 |
| 5,058,664 | 10/1991 | Gentry | 165/162 |

FOREIGN PATENT DOCUMENTS

| | | |
|---|---|---|
| 655900 | 5/1965 | Belgium . |
| 59-153097 | 8/1984 | Japan . |
| 59-130992 | 9/1984 | Japan . |
| 60-34953 | 10/1985 | Japan . |
| 62-29831 | 7/1987 | Japan . |
| 62-29832 | 7/1987 | Japan . |
| 62-47031 | 12/1987 | Japan . |
| 62-47032 | 12/1987 | Japan . |
| 63-49192 | 4/1988 | Japan . |
| 63-50637 | 10/1988 | Japan . |
| 63-53476 | 10/1988 | Japan . |
| 63-154982 | 10/1988 | Japan . |
| 63-44699 | 11/1988 | Japan . |
| 1056734 | 1/1967 | United Kingdom . |

*Primary Examiner*—Allen J. Flanigan

*Attorney, Agent, or Firm*—Oblon, Spivak, McClelland, Maier & Neustadt

[57] ABSTRACT

A heat exchange apparatus is composed of a plurality of tube banks arranged in rows each comprising a plurality of tubes arranged in a direction normal to a gas flow in a gas passage duct and in the heat exchanger, an interval of a space between mutually adjoining tube banks in the gas flow direction is less than eight times of a depth of a tube group disposed on an upstream side with respect to the gas flow and baffle plates are disposed in the respective tube banks for preventing a multibank tubing compound resonance. Each of the baffle plates disposed in an upstream side tube bank has an extension extending from a center of a most downstream side tube in the upstream side tube bank and having a length more than two times of a tube pitch in the gas flow direction, and each of the baffle plates disposed in a downstream side tube bank has an extension extending from a center of a most upstream side tube in the downstream side tube bank and having a length more than two times of a tube pitch in the gas flow direction.

12 Claims, 12 Drawing Sheets

HEAT EXCHANGE APPARATUS

BACKGROUND OF THE INVENTION

1. Field of the Invention

The present, invention relates to a heat exchanger utilized for a heat recovery steam generator in a combined cycle power generation plant or a convection section, and composed of a superheater, a reheater, an economizer and the like, of an outlet portion of a large-sized power generation radiant boiler In such a heat recovery steam generator or convection section, a plurality of tube banks are arranged in rows in a gas passage duct in a direction normal to a gas flow direction, and particularly, one in which the interval of a space between mutually adjoining tube banks is less than eight times the depth of a tube bank disposed on the upstream side and a resonance preventing baffle plate for preventing plural tube bank compound resonance is mounted in each of the tube banks. The depth is a distance from the central axis of the tube arranged on the most upstream side to the central axis of the tube arranged on the most downstream side as described hereinlater.

2. Prior Art

FIG. 6 is a schematic view showing a general structure of a multi-pressure type natural circulation heat recovery steam generator, in which exhaust gas from a gas turbine or the like first flows into a gas passage duct 1 of a natural circulation type heat recovery steam generator and then flows into a SCR (Selective Catalytic Reactor) 4 through a superheater 2 and a high-pressure evaporator 3. In the SCR 4, nitrogen oxide in the exhaust gas is removed. The exhaust gas discharged from the SCR 4 subsequently passes a high-pressure economizer 5, a low-pressure evaporator 6 and a low-pressure economizer 7 and is then subjected to heat exchanging operation with fluid inside the tubes constituting the respective tube banks. After heat exchanging operation, the exhaust gas is discharged into the atmosphere through a chimney, for example. A high-pressure steam and a low-pressure steam generated during the above process is utilized for a driving source of a steam turbine or an auxiliary heat source, for example. In FIG. 6, reference numeral 8 denotes a high-pressure steam drum and numeral 9 denotes a low-pressure steam drum The respective tube banks of the multi-pressure type natural circulation heat recovery steam generator of the character described above are constituted by a number of tubes 10, as schematically shown in FIGS. 7 and 8, extending in a direction normal to the flow direction of the exhaust gas. The tube arrangement (array) or layout shown in FIG. 7 may be called an in-line array and the tube arrangement or layout shown in FIG. 8 may be called a staggered array. Usually, a tube pitch in the exhaust gas flow direction is represented by $P_L$ and a tube pitch in the direction normal to the gas flow direction is represented by $P_T$.

The tubes 10 are disposed, as shown in FIG. 9, in an exhaust gas duct 1 which is comprised and separated from an external portion by duct side walls 11, a duct top wall 12 and a duct bottom wall 13.

When the tube banks are utilized for the natural circulation type of exhaust heat recovery steam generator, a finned tube 15 formed by securing a fin 14 to the tube 10, as shown in FIG. 10, may be utilized to enlarge the heat transfer surface area of the tube 10. It is a well known phenomenon that when an external fluid is flown in such tube banks, a vortex called the von Kerman's vortex is periodically generated with back flow in the tubes 10.

Generation frequency $f_K$ ($H_z$) of such vortex is shown by an equation:

$$f_x = S\ V/D \quad (1)$$

(S: the Strouhal number (0.2 in case of a single tube, but different in case of tube banks in accordance with tube array); V: gap flow velocity (flow velocity at an interval between the tubes) (m/s); D: outer diameter (m) of the tube)

While there exists a natural vibration mode determined by the physical properties of the gas between the duct side walls normal to the gas flow direction and the tube axis, and its frequency $f_n$ ($H_Z$) is represented as follows (in the case of gas, this frequency is called the frequency of standing wave oscillation).

$$f_n = nc/2L \quad (2)$$

(n=1, 2, 3—; c: speed of sound (m/s); L: width between duct side walls)

In the equation (2), the acoustic velocity c depends on a temperature of the gas of external fluid of the tube.

FIG. 11 shows the primary mode acoustic resonance (the primary mode) on the top side thereof and the secondary mode acoustic resonance (the secondary mode) on the bottom side thereof where a represents a node while b represents a loop.

As the load of the gas turbine changes, the temperature and the flow velocity of the exhaust gas flow from the gas turbine changes, and in a case where there is arranged a tube bank in which the generation frequency $f_K$ of the vortex caused by the back flow of the tube bank substantially accords with the frequency of standing wave oscillation $f_n$, acoustic vibration, so-called acoustic resonance, is caused between the duct side walls in the direction normal to the fluid flow direction and the axial direction of the tube, which may result in generation of noise harmful to an environmental area, thus being not desirable. Furthermore, in a case where the resonant frequency generation is a value near the natural frequency of the structure, vibration in a direction horizontal to the duct side walls or the tube may be caused.

In order to obviate such defects, in the prior art, as shown in FIG. 12, baffle plates 16 for preventing the generation of the acoustic resonance are inserted in the tube bank 15 by dividing the duct width with a depth substantially equal to the depth of the tube bank. In FIG. 12, the staggered tube array is shown as one example and two baffle plates 16 are inserted to prevent the acoustic resonance phenomenon to the secondary mode from generating.

In this arrangement of the baffle plates 16, acoustic resonance can be prevented in the case of the single tube bank. However, as shown in FIG. 13, for example, in the case of a heat exchanger constituted by a plurality of tube banks, it has been experienced that such acoustic resonance cannot be prevented by merely inserting such baffle plates 16.

FIG. 14 is a graph showing the influence of the numbers of the rows of the tube banks 15 on the acoustic resonance, and in the graph, examples of 6 rows, 4 rows and 3 rows of the tube banks are shown. As can be seen from this graph, in the cases of 6 rows and 4 rows, there are portions at which sound pressures project, thus causing the acoustic resonance, but in the case of 3 rows, no resonance is caused. However, it has been found through experiment that the acoustic resonance is caused when such 3 row tube banks are arranged in plural numbers. Such acoustic resonance caused in the arrangement of a plurality of tube banks is called herein as multibank tubing compound resonance.

FIG. 15 is a graph representing the relationship between the interval of the gap portions of the plural number of tube banks and the sound pressure level raising components upon the generation of the acoustic resonance in a case where two tube banks are arranged, and the sound pressure level raising component is shown by the ordinate at the generation of the acoustic resonance and values obtained by dividing the interval of the gap between the tube banks by the depth of the tube bank arranged on the upstream side are shown by the abscissa. The depth of the tube bank is the distance from the central axis of the tube arranged on the most upstream side to the central axis of the tube arranged on the most downstream side.

As can be seen from FIG. 15, in a case where a value obtained by dividing the gap distance by the depth of the tube bank arranged on the most upstream side is less than 8 times, the raising of the sound pressure level is not observed, but in the case of less than 8 times, the raising of the sound pressure level is observed. In view of this phenomenon, it is considered that phenomenon substantially the same as that in the case of the single tube bank is caused in the case of the gap distance between the upstream side tube bank and the downstream side tube bank being less than 8 times the depth of the upstream side tube bank. In the case of the single tube bank, it has been shown through experiment that the acoustic resonance cannot be prevented in a case where a gap exists between the resonance-preventing baffle plates inserted into the tube bank.

In addition, it has been determined that the noise level will rise when the tube bank depth LA on the upstream side in FIG. 15 is equal and the gap LB of the cavity portion is short, and similarly, that the noise level will also rise when the tube bank depth LA on the upstream side is deep and when the gap LB of the cavity portion is equal.

Further, even in the case of the plural tube banks, these tube bank respectively behave as a single tube bank in the case of the gap or distance between the upstream and downstream side tube banks being more than 8 times of the depth of the upstream side tube bank.

SUMMARY OF THE INVENTION

An object of the present invention is to substantially eliminate defects or drawbacks encountered in the prior art and to provide an improved heat exchanger including a plurality of tube banks capable of effectively preventing the generation of multibank tubing compound resonance phenomenon which is likely to be caused in the heat exchanger composed of a plurality of tube banks extending in a direction normal to an exhaust gas flow direction.

This and other objects can be achieved according to the present invention by providing a heat exchange apparatus which is composed of a plurality of tube banks arranged in rows each comprising a plurality of tubes arranged in a direction normal to an exhaust gas flow in a gas passage duct and in which an interval of a space between mutually adjoining tube banks in the gas flow direction is less than eight times a depth of a tube bank disposed on an upstream side with respect to the gas flow, and baffle plates are disposed in the respective tube banks by dividing the duct width for preventing a multibank tubing compound resonance, wherein each of the baffle plates disposed in an upstream side tube bank has an extension extending from a center of a most downstream side tube in the upstream side tube banks, and having a length more than two times a tube pitch in the gas flow direction, each of the baffle plates disposed in a downstream side tube bank having an extension extending from a center of a most upstream side tube in the downstream side tube bank and having a length more than two times a tube pitch in the exhaust gas flow direction.

The plurality of tube banks is composed of two tube banks comprising upstream side tube banks and downstream side tube banks with respect to the gas flow direction.

In a modified embodiment, the plurality of tube banks are composed of three tube banks comprising the upstream side tube banks, the downstream side tube banks and intermediate tube banks arranged in rows with respect to the gas flow direction. Each of the baffle plates disposed in the intermediate tube banks has an extension extending from a center of a most upstream side tube in the intermediate tube banks, and has a length more than two times of a tube pitch in the gas flow direction, and an extension extending from a center of a most downstream side tube in the intermediate heat exchanger tube banks and having a length more than two times of a tube pitch in the gas flow direction.

At least two baffle plates are disposed in the upstream side, intermediate and downstream side tube banks.

In the embodiment of the heat exchanger of the structure described above, the maximum extension at the end of one baffle plate in one tube bank does not contact the maximum extension at the end of one baffle plate in adjoining tube banks.

According to the heat exchanger of the structure described above, on the downstream side tube banks and the upstream side tube banks adjoining the downstream side one, the acoustic vibration, i.e. acoustic resonance phenomenon, can be suppressed to the predetermined mode, at inlet and outlet portions of the tube bank, and corresponding to the baffle plates having extensions on the upstream side and the downstream side of the above mentioned tube banks, whereby the coincidence of the natural frequency of acoustic vibration with the frequency of the generated vortex at the back flow portion of the tube bank can be prevented and the generation of horizontal vibration of a duct and the tubes as well as the generation of noise due to resonance can also be prevented.

The nature and further features of the present invention will be made clearer through the following description made in conjunction with the accompanying drawings.

DESCRIPTION OF THE PREFERRED EMBODIMENTS

Preferred embodiments according to the present invention will be described hereunder with reference to FIGS. 1 to 5.

Figure 1:
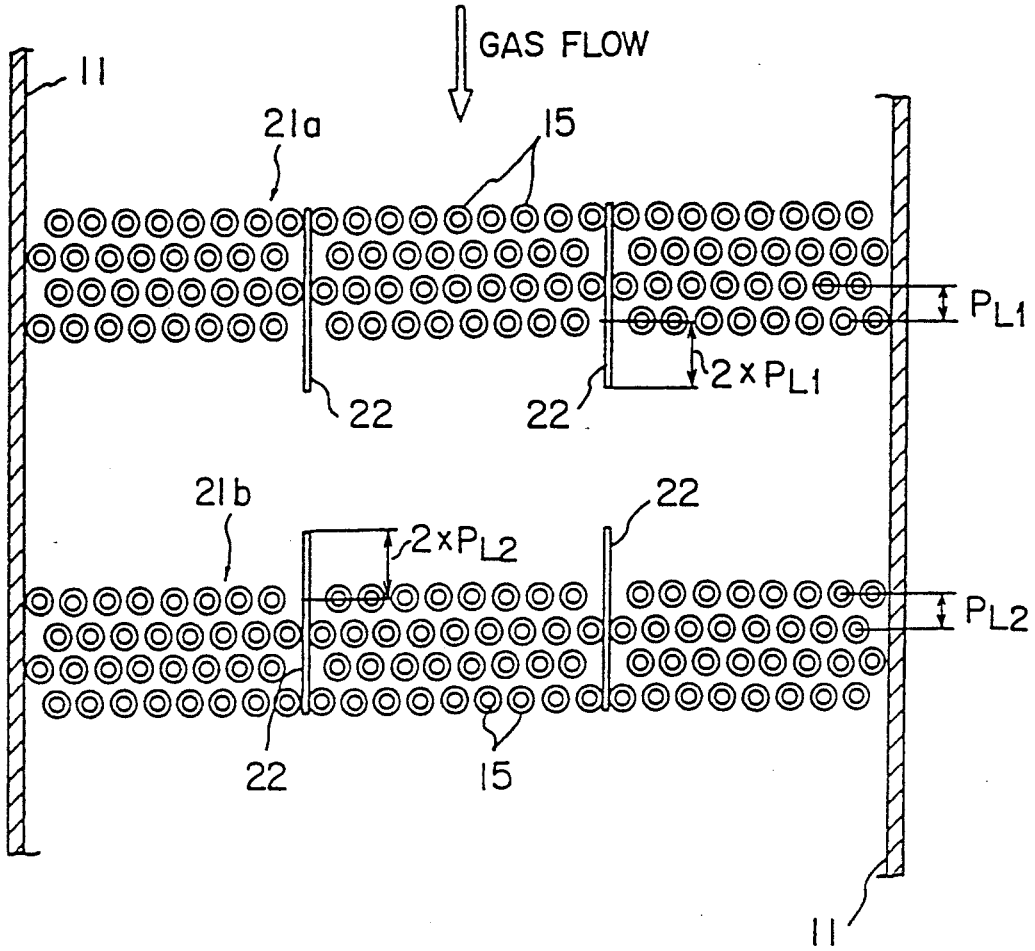
FIG. 1 is a horizontal sectional view showing an arrangement of tube banks of a heat exchanger of one embodiment according to the present invention.

FIG. 1 shows an arrangement of two tube banks 21*a* and 21*b*, arranged in rows, including tubes 15 arranged in staggered state, in a gas passage duct 11. Both the tube banks 21*a* and 21*b* are provided with two resonance preventing baffle plates 22, respectively, by dividing the duct width for preventing multibank tubing compound resonance in the secondary mode.

Figure 2:
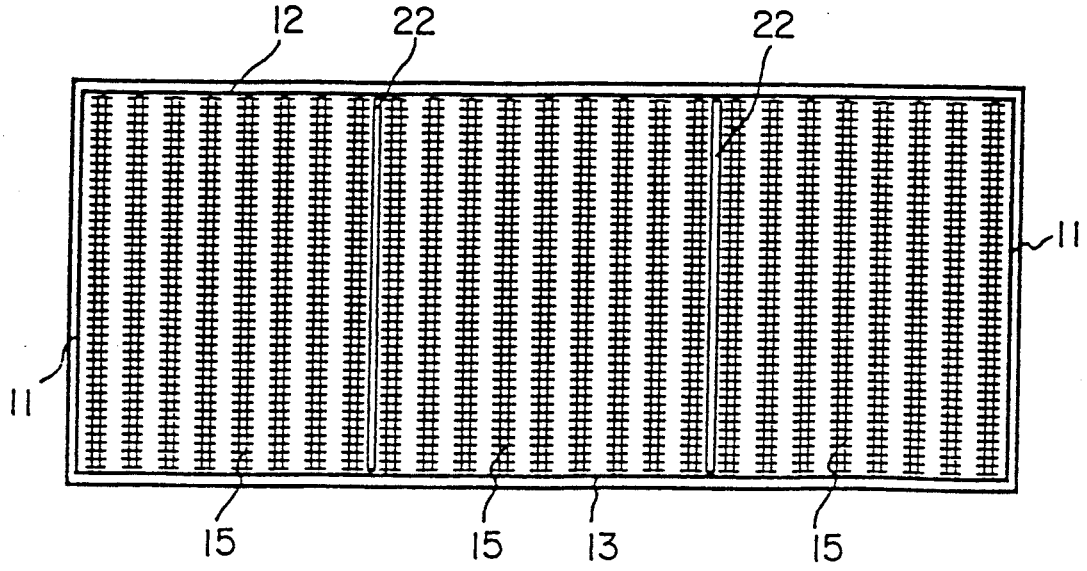
FIG. 2 shows an elevational section showing the heat exchanger of FIG. 1.

As shown in FIG. 2, the baffle plates 22 .are disposed to a duct top wall 12 and a duct bottom wall 13 throughout the entire length therebetween and parallel to the axis of the tube 15 and further, parallel to the flow direction of the exhaust gas as shown in FIG. 1. The baffle plates 22 on the upstream and downstream sides are arranged on the same axial line in the gas flow direction.

In the present embodiment, as shown in FIG. 1, when a tube pitch of the upstream side tube bank 21*a* with respect to the exhaust gas flow is determined to $P_{L1}$ and that of the tube bank 21*b* of the downstream side is determined to $P_{L2}$, the baffle plate 22 disposed in the upstream side tube bank 21*a* has a downstream side extension of the length of at least $2\times P_{L1}$ from the center of the most downstream side tube 15 in the tube bank 21*a*, while the baffle plate 22 disposed in the extension of the length of at least $2\times P_{L2}$ from the center of the most upstream side tube 15 in the tube bank 21*b*.

Further, it is determined that the maximum extension length or extension point of the baffle plate 22 is not to a point at which the paired baffle plates 22 disposed in the respective tube do not interfere with each other, that is, a point at which these baffle plates 22 contact each other.

Figure 3:
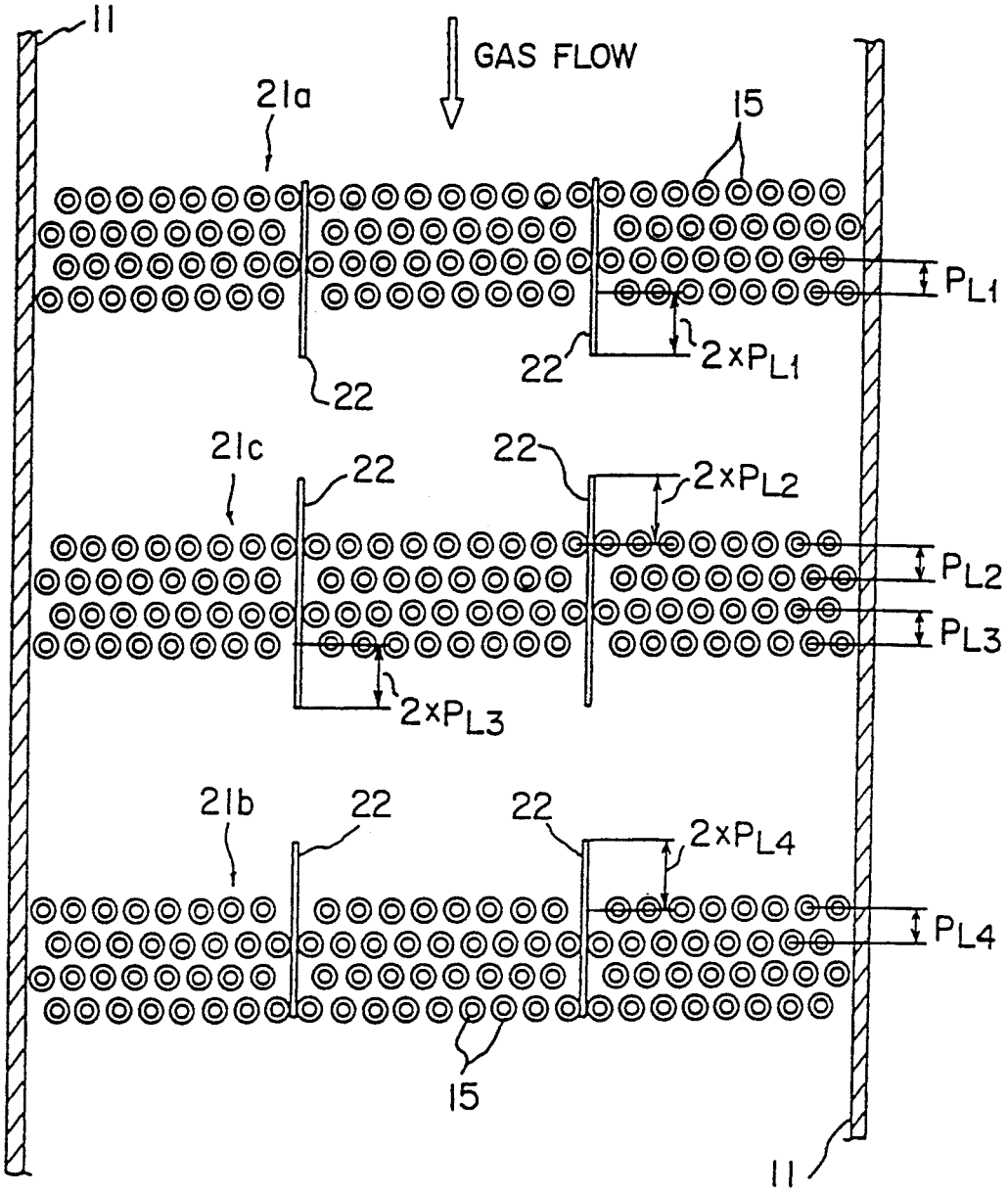
FIG. 3 is a view similar to that of FIG. 1 but related to another embodiment of the present invention.

FIG. 3 represents another embodiment showing an arrangement of three tube banks, in which two resonance preventing baffle plates 22 are disposed in each of these tube banks 21*a*, 21*b* and 21*c*, each arranged in rows. In this embodiment, when a tube pitch of the most upstream side tube bank 21*a* with respect to the exhaust gas flow is determined as $P_{L1}$, a tube pitch of the tube bank 21*b* of the most downstream side is determined as $P_{L4}$, a tube pitch of the tube of the intermediate tube bank 21*c* on the most upstream side is determined as $P_{L2}$ and a tube pitch of the tube of the tube bank 21*c* on the most downstream side is determined to $P_{L3}$, the baffle plate 22 disposed on the most upstream side tube bank 21*a* has a downstream side extension of the length of at least $2\times P_{L1}$ from the center of the most downstream side tube 15 in the tube bank 21*a*. The baffle plate 22 disposed in the intermediate tube bank 21*c* has an upstream side extension of a length of at least $2\times P_{L2}$ from the center of the most upstream side tube 15 in the tube bank 21*c* and also has a downstream side extension of a length of at least $2\times P_{L3}$ from the center of the most downstream side tube 15 in the tube bank 21*c*. The baffle plate 22 of the most downstream side tube bank 21*b* has an upstream side extension projecting to the upstream side by a length of at least $2\times P_{L4}$ from the center of the most upstream side tube 15 in the tube bank 21*b*.

With reference to the heat exchangers shown in FIGS. 1 and 3, the acoustic vibration to the secondary mode can be suppressed by the baffle plates 22 projecting in the gaps formed between both the tube banks 21*a* and 21*c* on, for example, the downstream side of the tube bank 21*a* and on the upstream side of the tube bank 21*c* adjoining the abovementioned tube bank 21*a* on its downstream side. In this region, the natural frequency of the acoustic vibration can be prevented from being in agreement with the frequency due to the vortex generated at the back flow of the tube banks. Accordingly, the generation of noise caused by acoustic resonance can be remarkably reduced.

In addition, due to the fact that the baffle plates disposed in the upstream side tube bank and the baffle plates disposed in the downstream side tube bank are separated by gaps formed between both the tube banks, the exhaust gases separately coming from each row are mixed in the gaps. Thus, the temperature and the flow velocity of the exhaust gases are substantially uniform at the inlet end of the downstream side tube bank. Consequently, the decrease of the heat exchanging performance at the downstream side tube bank is remarkably prevented.

Figure 4:
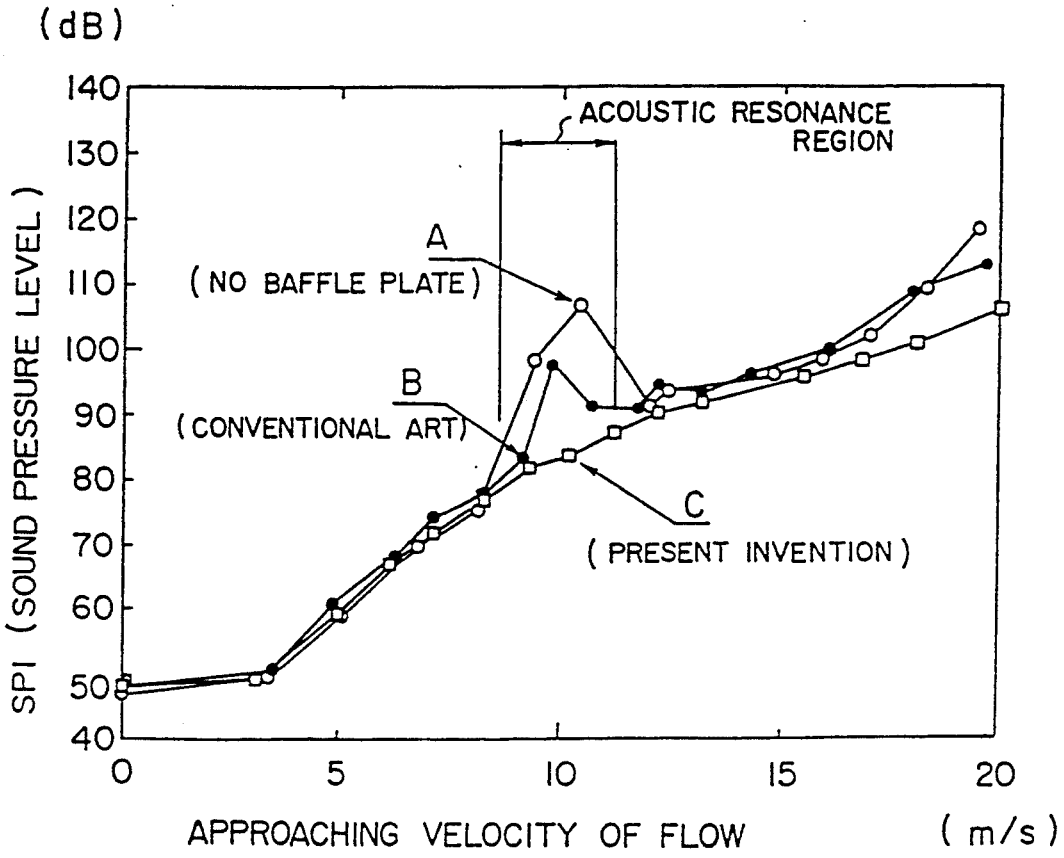
FIG. 4 is a graph showing an experimental result of sound pressure level changes in the heat exchanger according to the present invention and that of the prior art.

FIG. 4 is a graph showing experimental results for the change of the sound pressure level with respect to the approaching velocity of the exhaust gas flow towards the tube banks. In the graph of FIG. 4, the letter A represents a case wherein no baffle plate is disposed, the letter B represents a case wherein conventional baffle plates are disposed, and the letter C represents a case according to the embodiment of the present invention.

As can be seen from FIG. 4, the case A includes a region in which the sound pressure level is rapidly increased, showing that acoustic resonance phenomenon is caused. The case B also includes a region in which the acoustic resonance phenomenon is caused although the sound pressure level is smaller by about 10dB in comparison with the case A. On the contrary, the case C representing the present invention includes no region in which the sound pressure level is rapidly changed, showing that substantially no acoustic resonance phenomenon is caused, and in addition, it will be found that the sound pressure level in the case C is remarkably smaller by about 25dB than that for case A.

Further referring to FIG. 4, it is observed that the sound pressure level caused at a portion at which the approaching velocity is nearly 10 m/s, is smaller than that caused at a portion at which the approaching velocity is nearly 20 m/s, but this constitutes no specific problem because a noise characteristic at the portion at which the approaching velocity is nearly 20 m/s is generally called white noise and the sound pressure level is rapidly decreased with distance from the sound source. On the other hand, the characteristic of the resonance sound generated at the portion at which the approaching velocity is nearly 10 m/s, is a pure sound and includes low frequencies, so that the sound pressure level is not rapidly decreased even with distance from the sound source, and for example, this is a cause of noise problems in electric power station. However, according to the embodiment of the present invention, since as shown in FIG. 4 as the case C, there is no point at which the sound pressure level is rapidly changed, such noise problems are not caused.

Figure 5:
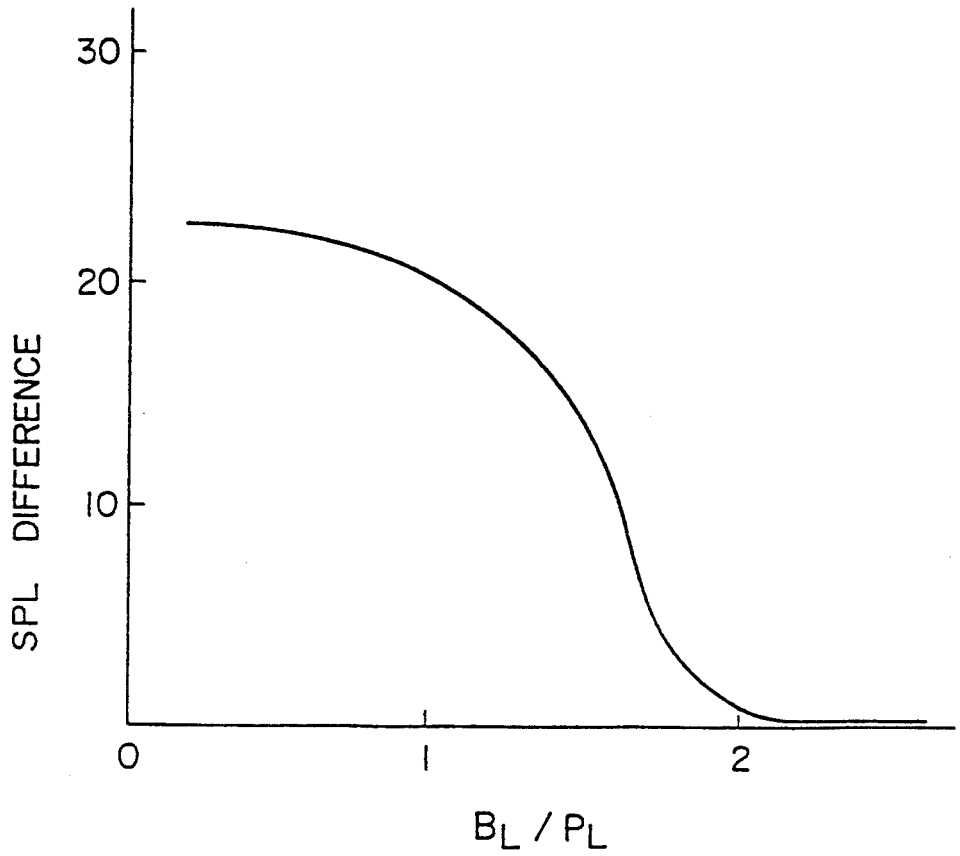
FIG. 5 is a graph showing the change of lowering amount of the sound pressure level at the time of generation of a resonance with the extension of a baffle plate being a parameter.
Figure 6:
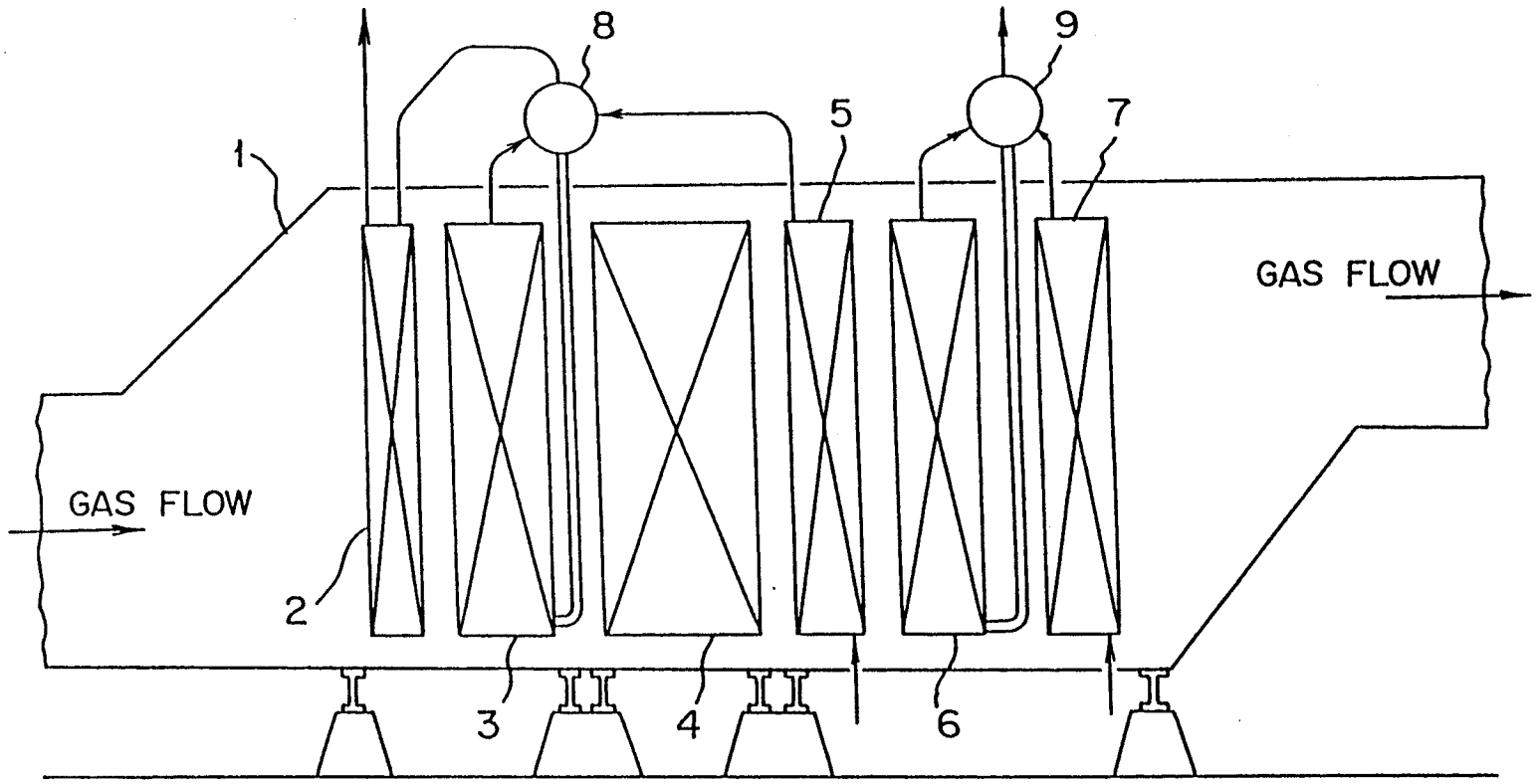
FIG. 6 is a schematic illustration showing an entire structure of a general multi-pressure type natural circulation heat recovery steam generator.
Figure 7:
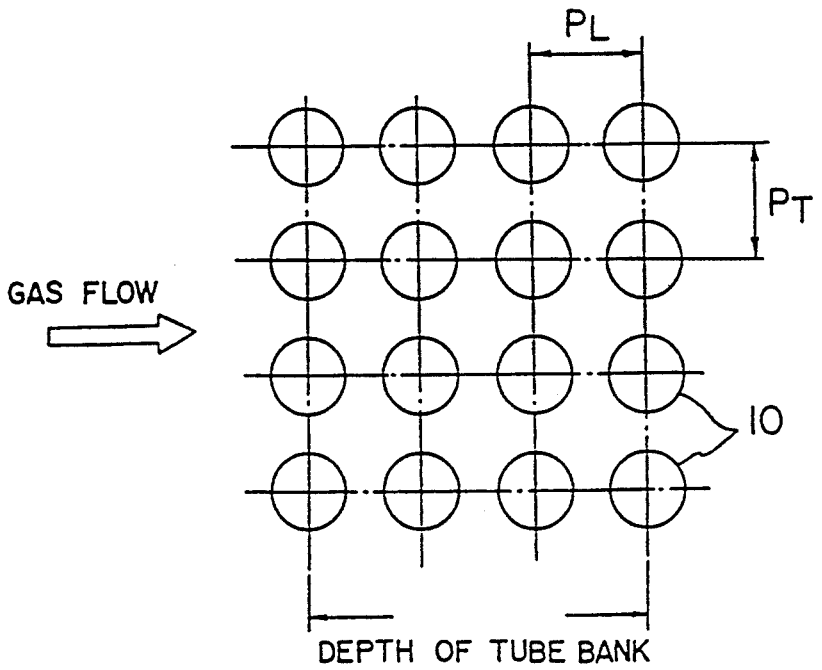
FIGS. 7 and 8 show arrangements of tubes in a general heat exchanger.
Figure 8:
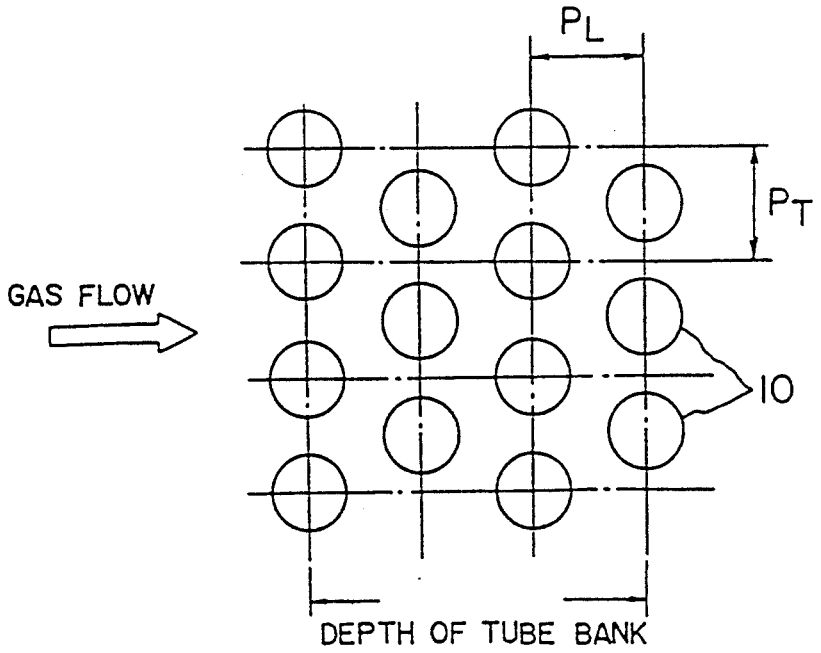
Figure 9:
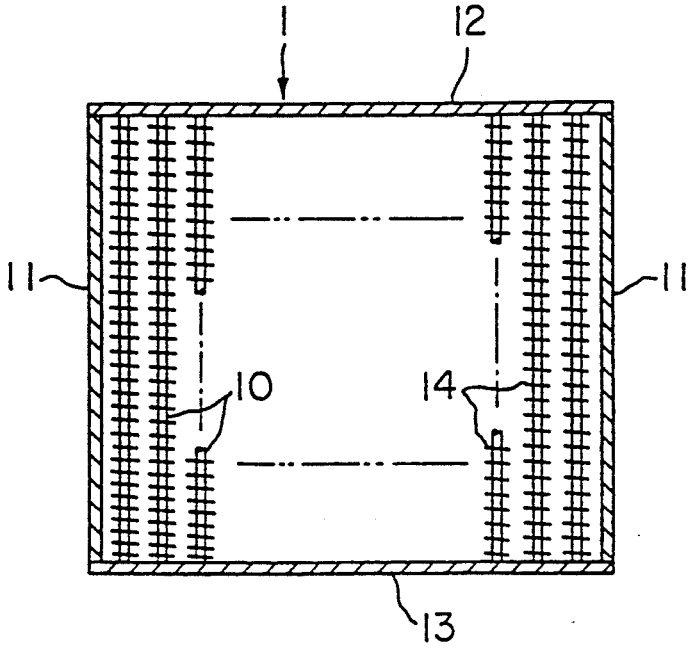
FIG. 9 shows a section of the heat recovery steam generator of FIG. 6.
Figure 10:
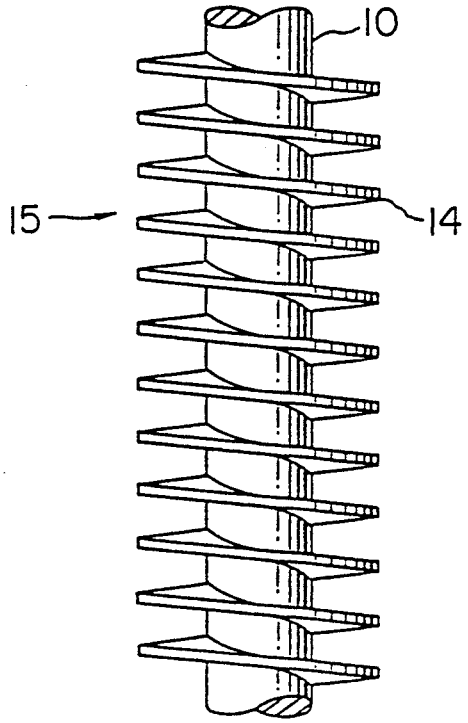
FIG. 10 shows a perspective view of a finned tube.
Figure 11:
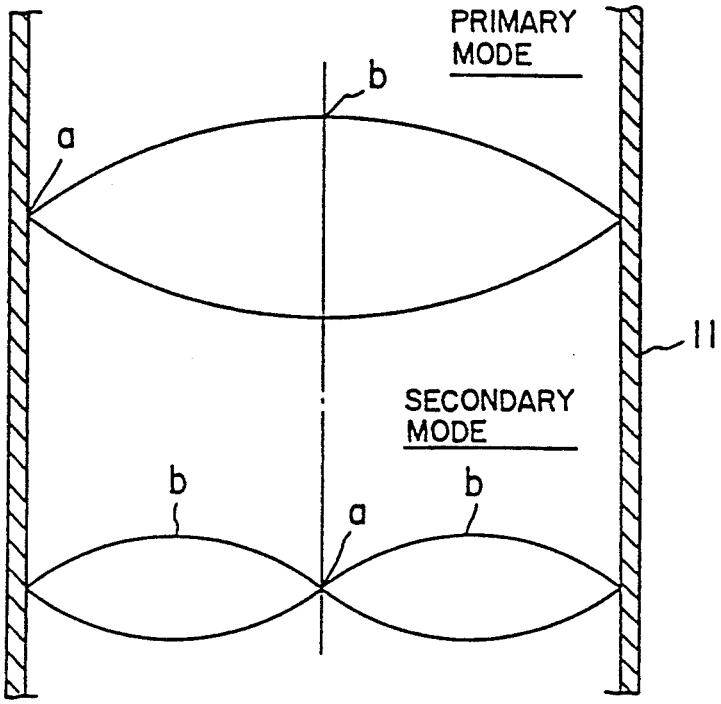
FIG. 11 is a view showing primary and secondary modes of a velocity component of a acoustic vibration in a gas passage duct.
Figure 12:
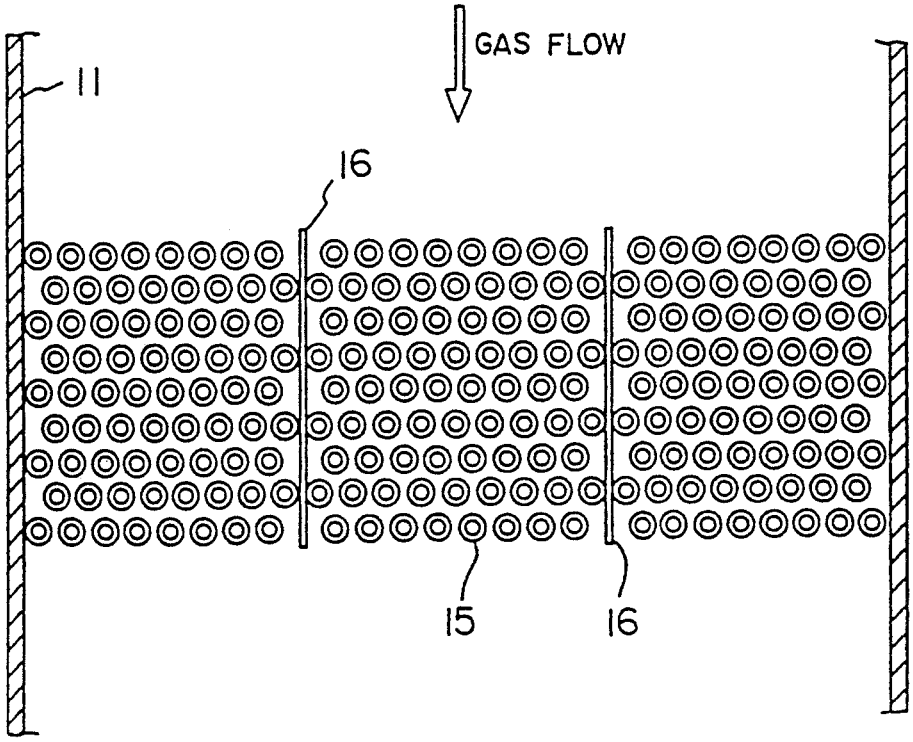
FIG. 12 is a horizontal sectional view showing one example of a heat exchanger of the prior art provided with acoustic vibration preventing baffle plates.
Figure 13:
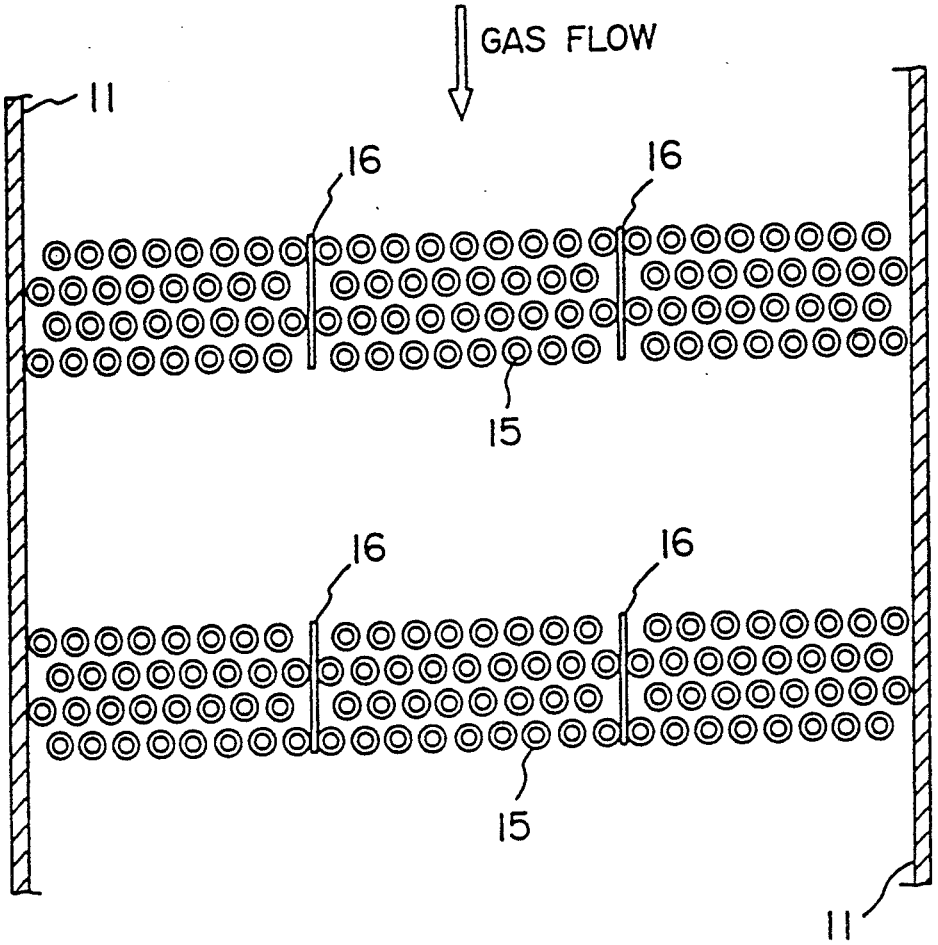
FIG. 13 is a view similar to that of FIG. 12 but related to another example.
Figure 14:
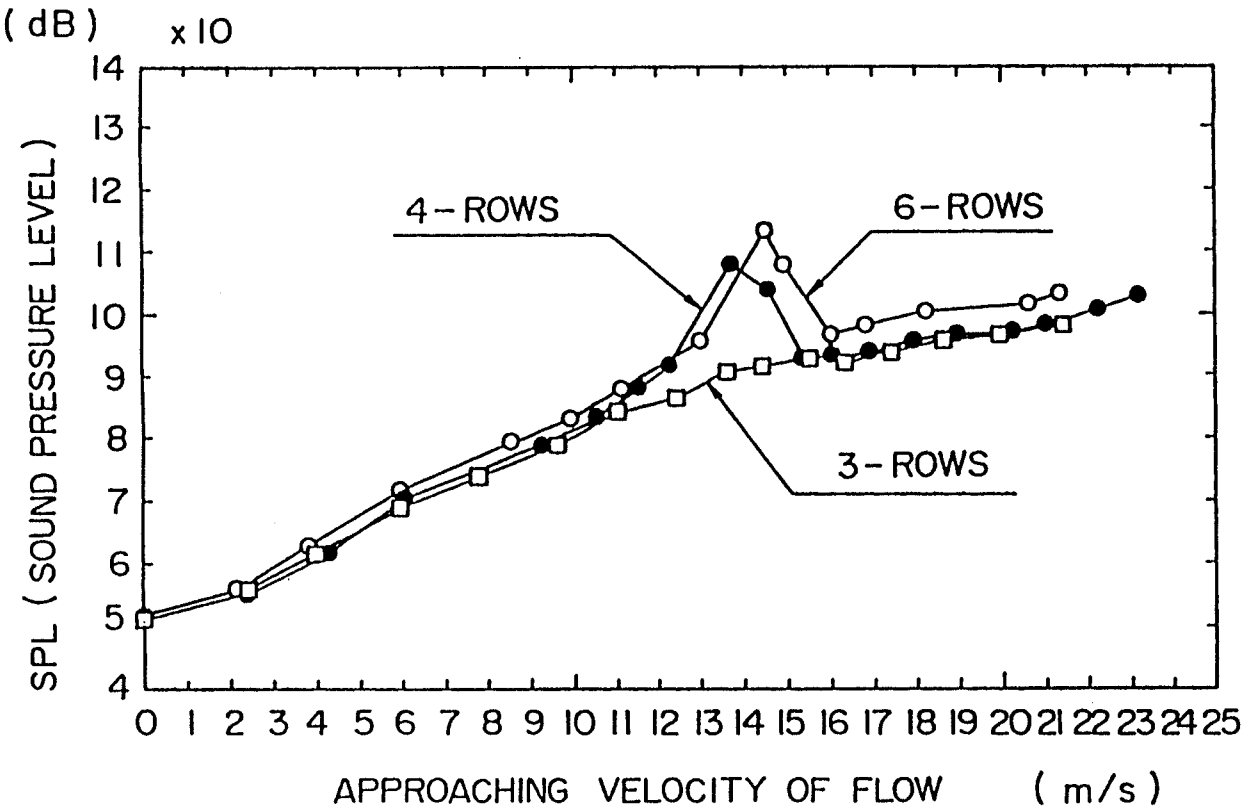
FIG. 14 is a graph showing influence of the number of rows of the tube banks on the acoustic resonance.
Figure 15A:
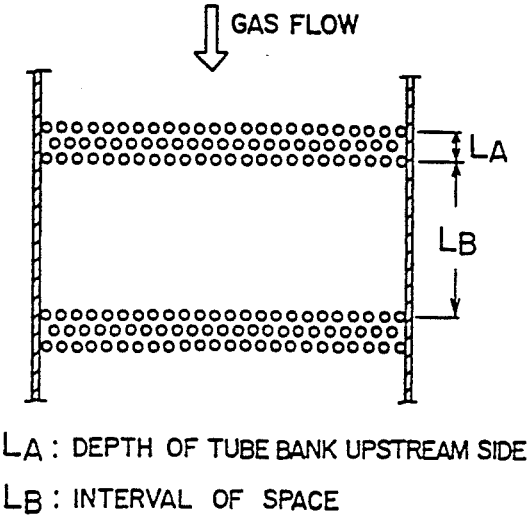
FIG. 15 is a graph showing a relationship between an interval between the plural tube banks and the raising of the sound pressure level at the time of generation of the acoustic resonance.
Figure 15B:
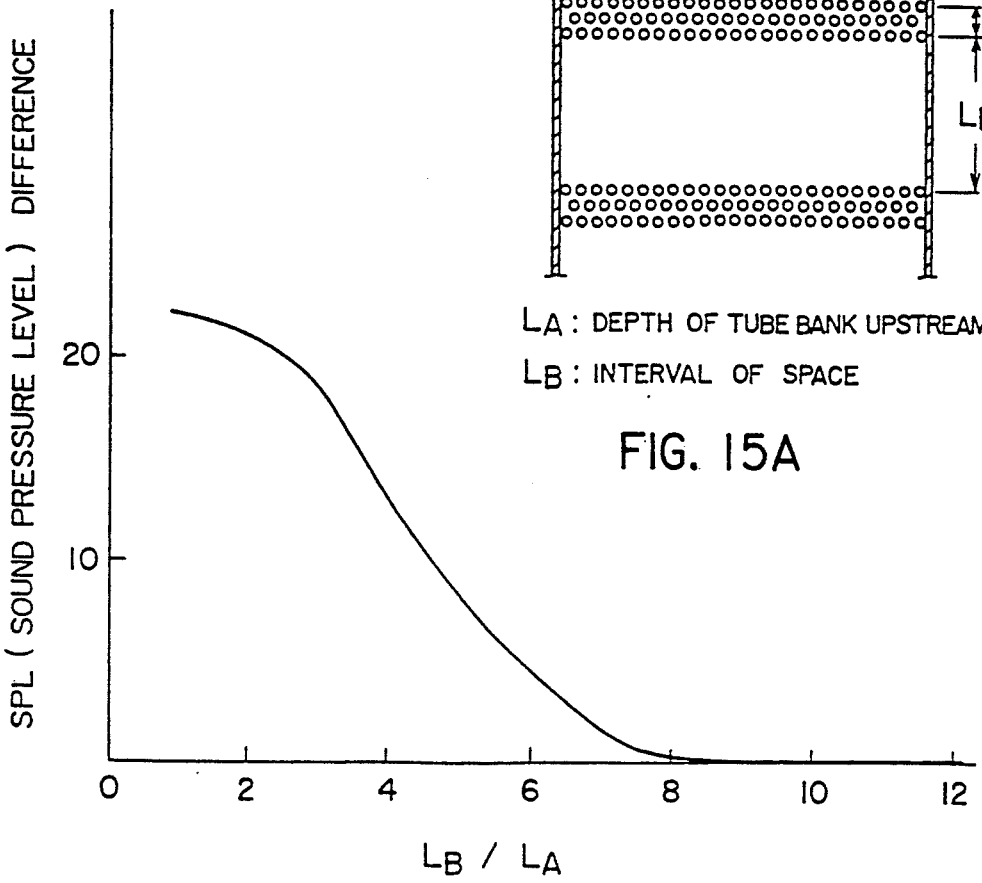

FIG. 5 shows a graph showing experimental results in which the experiments were performed with respect to the amount of lowering of the sound pressure level at the generation of the acoustic resonance with a parameter of $B_L$ representing the length of extension from the central axis of the tube on the most downstream gas flow side from the baffle plate. In FIG. 5, the axis of the abscissa represents a value obtained by dividing the extended length $B_L$ of the baffle plate by the tube pitch $P_L$ of the tube banks in the gas flow direction and the axis of the ordinate represents the difference in the sound pressure levels between the case where the acoustic resonance is generated and the case where no acoustic resonance is generated.

As can be seen from FIG. 5, the difference in the sound pressure levels gradually reduces till the extended length $B_L$ of the baffle, i.e. axis of abscissa, becomes two times the tube pitch $P_L$ of the tube bank in the exhaust gas flow direction, and in the case of more than two times, the difference in the sound pressure levels is substantially absent. This shows the fact that the location of the baffle plate having an extension as shown in FIGS. 1 and 3 can suppress or regulate the sound pressure level, and particularly, that the acoustic resonance can be suppressed by extending the baffle plate by setting the extended length $B_L$ of the baffle plate two times of the tube pitch $P_L$ of the tube bank in the gas flow direction.

As can be understood from the experimental results shown in FIGS. 4 and 5, the generation of multibank tubing compound resonance can be prevented by arranging the baffle plates of the structure described above and according to the present invention.

In a case where four or more than four tube banks are arranged, the baffle plates having the structure substantially the same as that of the case of the three tube banks are arranged. Furthermore, since the generation of the resonance is preliminarily predicted from the temperature of the exhaust gas and the layout of the tube banks, it will not be necessary to arrange the baffle plates according to the present invention, to all the tube banks in the case where a large number of tube banks such as in the case of the natural circulation type heat recovery steam generator, and such baffle plates may be arranged to the plural number of tube banks disposed at the front and rear sides of the tube banks at which the generation of the resonance will be predicted.

In the above embodiment, there is described a preferred example of a natural circulation type heat recovery steam generator, but the present embodiment may be applied to an optional kind of heat exchanger system. For example, a plurality of tube banks are arranged in the gas passage duct in a heat exchanger apparatus such as a superheater, a reheater, an economizer or the like constituting a convection heat transfer surface at the outlet portion of a radiant boiler utilized for a large-sized power generation plant, as in the case of the heat recovery steam generator. In such a case, the multibank tubing compound resonance can be prevented by arranging the baffle plates of the structure according to the present invention. Furthermore, in the above description, a finned tube is mentioned, but the present invention is of course applicable to a tube bank composed of ordinary bare tubes provided with no fins.

What is claimed is:

1. A heat exchange apparatus which is composed of a plurality of tube banks arranged in rows, each of said tube banks comprising a plurality of tubes arranged in a direction normal to an exhaust gas flow in a gas passage duct, and in which an interval of a first space between adjacent tube banks in the gas flow direction is less than eight times of a depth of a tube bank disposed on an upstream side with respect to the exhaust gas flow, and baffle plates are disposed parallel to said gas flow direction in each of the respective tube banks by dividing the duct width so as to prevent multibank tubing compound resonance, each of the baffle plates disposed in an upstream side tube bank having an extension extending into said first space from a center of a most downstream side tube in the upstream side tube bank and having a length more than two times of a tube pitch in the gas flow direction, and each of the baffle plates disposed in an adjacent downstream side tube bank having an extension extending into said first space from a center of a most upstream side tube in the downstream side tube bank and having a length more than two times of a tube pitch in the gas flow direction, wherein a maximum extension into said first space of the baffle plate extensions of the upstream side tube bank does not contact or overlap a maximum extension into said first space of the baffle plate extensions of the adjacent downstream side tube bank, and a second space within said first space is defined between end portions of the baffle plate extensions of the upstream side tube bank and end portions of the baffle plate extensions of the adjacent downstream side tube bank.

2. The heat exchange apparatus according to claim 1, wherein said plurality of tube banks are composed of two tube banks comprising an upstream side tube bank and a downstream side tube bank with respect to the exhaust gas flow direction.

3. The heat exchange apparatus according to claim 2, wherein at least two baffle plates are disposed in each of the upstream side and downstream side tube banks.

4. The heat exchange apparatus according to claim 1, wherein said plurality of tube banks are composed of three tube banks comprising an upstream side tube bank, a downstream side tube bank and an intermediate tube bank arranged in a row with respect to the gas flow direction.

5. The heat exchange apparatus according to claim 1, wherein each tube of said tube banks is installed in an in-line array.

6. The heat exchange apparatus according to claim 1, wherein each tube of said tube banks is installed in a staggered array.

7. The heat exchange apparatus according to claim 1, wherein said baffle plates are disposed in a direction normal to the gas flow in the gas passage duct so as to prevent multibank tubing compound resonance.

8. The heat exchange apparatus according to claim 1, wherein the number of said baffle plates installed corresponds to the number of the mode of the acoustic resonance caused between the duct side walls.

9. The heat exchange apparatus according to claim 1, wherein each tube of said tube banks is a bare tube.

10. The heat exchange apparatus according to claim 1, wherein each tube of said tube banks is a fin tube.

11. The heat exchange apparatus according to claim 4, wherein each of the baffle plates disposed in the intermediate tube bank has an extension extending from a center of a most upstream side tube in the intermediate tube bank and having a length more than two times of a tube pitch in the gas flow direction and has an extension extending from a center of a most downstream side tube in the intermediate tube bank and having a length more than two times of a tube pitch in the gas flow direction.

12. The heat exchange apparatus according to claim 11, wherein at least two baffle plates are disposed in the intermediate tube bank

* * * * *